US005853015A

United States Patent [19]

Evans

[11] Patent Number: 5,853,015

[45] Date of Patent: Dec. 29, 1998

[54] LIGHTWEIGHT EASILY TRANSPORTABLE PERSONAL LIFTING DEVICES

[76] Inventor: Allan B. Evans, 821 Regan Rd., Somerset, Mass.

[21] Appl. No.: 351,588

[22] Filed: Dec. 7, 1994

[51] Int. Cl.[6] ..... A61H 3/00

[52] U.S. Cl. ..... 135/67; 5/86.1; 5/81.1; 297/DIG. 10; 482/69

[58] Field of Search ..... 5/86.1, 81.1; 135/67, 135/69, 66; 280/57.021, 87.041, 87.05, 87.051; 482/66, 68, 69; 297/DIG. 10

[56] References Cited

U.S. PATENT DOCUMENTS

| | | | |
|---|---|---|---|
| 2,996,070 | 8/1961 | Ries | 135/67 |
| 3,553,746 | 1/1971 | Seiger . | |
| 3,591,874 | 7/1971 | O'Kennedy . | |
| 3,596,298 | 8/1971 | Durst . | |
| 3,894,303 | 7/1975 | Angel | 297/DIG. 10 |
| 3,999,288 | 12/1976 | Thomas . | |
| 4,251,105 | 2/1981 | Barker | 135/67 |
| 4,443,902 | 4/1984 | Baer | 5/81.1 |
| 4,510,956 | 4/1985 | King . | |
| 4,802,542 | 2/1989 | Houston . | |
| 4,947,497 | 8/1990 | Marchand . | |
| 4,985,947 | 1/1991 | Etheridge . | |
| 5,112,076 | 5/1992 | Wilson | 5/81.1 |
| 5,411,044 | 5/1995 | Andolfi | 5/86.1 |

OTHER PUBLICATIONS

Sabelman EE. Self Operated Lift for the Disabled. Fed. Res in Progress, ID#77210;006 640, Feb. 1, 1990.

*Primary Examiner*—Flemming Saether

*Attorney, Agent, or Firm*—Debra A. Gaw

[57] ABSTRACT

This invention describes lifting devices that enable a partially ambulatory person to rise from a sitting position without the assistance of another person. The lifting device preferably comprises a base support in a substantially U-shaped frame having a user receptive front and a spaced apart rear formed by two front legs separated by front support braces and each front leg being connected to a rear leg at a cross support, thereby forming sides of the device. Hand rails are slidably mounted with each pair of front and rear legs.

An linear actuator mechanism is connected through the frame to the underside of each hand rail and provides synchronous telescoping action to the hand rails. The linear actuator mechanism is comprised of a gear motor, and gear reducer mounted on an actuator support, a ball nut fixedly mounted within the cross support, and a ball screw fixed at one end to the gear reducer, engaging the ball nut and ultimately attached to the hand rail. Power to the linear actuator mechanism from the power supply is controlled by means of a rocker switch positioned under one of the hand rails. When the linear actuator mechanism is powered, the gear motor drives the gear reducer, which rotates the ball screw. Since the ball nut is fixed in its position, the ball screw travels its length through the ball nut, thereby moving the attached the hand rails with respect to the frame. The two position rocker switch can engage the linear actuator mechanism to either retract or extend the handles.

The lifter can be folded for storage or transport and can be fabricated from light weight materials such as aluminum. Wheels can be attached to the bottom of the legs for smooth movement over a surface.

8 Claims, 3 Drawing Sheets

LIGHTWEIGHT EASILY TRANSPORTABLE PERSONAL LIFTING DEVICES

TECHNICAL FIELD

This invention relates to devices for assisting a partially ambulatory person to rise from a sitting position to a standing position without the assistance of another person.

BACKGROUND OF THE INVENTION

Many physically disabled and elderly individuals have difficulty rising from a sitting position, such as in a chair, to a standing position without the aid of a another person. Such persons may be capable of walking alone or with moderate support once they are upright, but have difficulty achieving a standing position on their own due to injury or degeneration of muscles as with illness. Various lifters and support devices have been developed to assist these individuals. For example, U.S. Pat. No. 3,553,746 issued to Seiger on Jan. 12, 1971 discloses a rigid generally T-shaped framework designed to assist an individual in arising from a bed. The individual grasps the handles and maneuvers himself out of bed. In U.S. Pat. No. 3,99,228 issued to Thomas on Dec. 28, 1976, a pulley system-power hoist device is described. The patient is strapped into a the device and the pulley system pulls him upright; the power hoist allows patient to be supported while he moves about the room. U.S. Pat. No. 3,591,874 issued to Kennedy on Jul. 13 1971, describes a device comprising a platform with a levered handle bar. The patient grasps the handlebar and pulls himself to a standing position. Etheridge (U.S. Pat. No. 4,985,947, issued Jan. 21, 1991) discloses a yoked machine to aid a person in standing and moving. The patient's weight is supported in the yoke that is winch driven. When engaged the yoke raises the patient and supports his weight while he moves about using the wheeled frame.

These devices are impractical for the person who needs only assistance in rising from a chair or bed. Such devices are also not suitable for use in restricted areas.

Numerous walker type supporters and lifters are also known in the art. King (U.S. Pat. No. 4,510,956, issued Apr. 16, 1985) describes a wheeled walker-type apparatus in which the user leans on the arms and pushes himself forward. Durst (U.S. Pat. No. 3,596,298, issued Aug. 3, 1971) comprises a wheeled frame adapted to lift a patient from a seated to a standing position. The user leans against a cushioned back rest and is meanwhile supported under his arms. Hydraulic cylinders are engaged to raise the cushioned back and arm rests, and thereby lift the user.

These devices generally require the assistance of another person in positioning the user within the framework. Many cannot be used in restricted access areas or require supporting frame work not found in residential settings. These devices are generally cumbersome to be transportable and thus can not assist the user in places such as restaurants and other areas to which the user may wish to travel. Also, these devices are limited in that they can be used only when the user is in a chair or sitting on the edge of a bed, and are unusable if the patient is lying on the floor, as in after a fall.

SUMMARY OF THE INVENTION

It is the object of the present invention to provide a personal lifting device for physically disabled persons that does not require the assistance of a second person for operation, is light weight, easily transportable, and assists a user in rising from a sitting position to a standing position from any chair, or from a lying position to a eventually a sitting or standing position. My invention does not require specialized modifications to the user's living area, and can be conveniently transported to and used in other places such as restaurants, houses of worship, and other people's homes.

My invention preferably comprises a base support in a substantially U-shaped frame having a user receptive front and a spaced apart rear formed by two front legs separated by front support braces and each front leg being connected to a rear leg at a ball nut support, thereby forming sides of the device. Hand rails are slidably mounted with each pair of front and rear legs.

A linear actuator mechanism is connected through the frame to the underside of each hand rail and provides synchronous telescoping action to the hand rails. The linear actuator mechanism is comprised of a gear motor, and gear reducer mounted on an actuator support, a ball nut fixedly mounted within the ball nut support, and a ball screw fixed at one end to the gear reducer, engaging the ball nut and ultimately attached to the hand rail. Power to the linear actuator mechanism from the power supply is controlled by means of a rocker switch positioned under one of the hand rails. When the linear actuator mechanism is powered, the gear motor drives the gear reducer, which turns the ball screw. Since the ball nut is fixed in position, the ball screw travels its length through the ball nut, thereby moving the attached the hand rails with respect to the frame. The two position rocker switch can engage the linear actuator mechanism to either retract or extend the handles.

The hand rails are secured to the front braces by a locking hinge mechanism that allows the lifter to be folded for storage or transport. The device can be fabricated from light weight materials such as aluminum . Wheels can be attached to the bottom of the legs for smooth movement over a surface; height adjustable tubes can be added to the bottom of the legs to customize the height for the individual user. The hand rails can be padded for comfort.

An alternate configuration for my invention comprises a base support having four legged base with four vertical frame supports arising from the top. The frame supports each contain a longitudinal channel, and are secured at their tops by a ball nut support. The hand rail consists of a handle supported by a ball screw that turns through a ball nut fixedly mounted in the ball nut support and the ball screw is further connected to a moving platform. The platform contains guides to secure it within the longitudinal channels of the frame supports. Elevation controls are mounted to the handle. The user leans on the handle and engages the switch to activate the gear motor drives the gear reducer, which turns the ball screw. The ball screw travels it length through the fixed ball nut and thereby raises the handle.

DETAILED DESCRIPTION OF THE INVENTION

Figure 1:
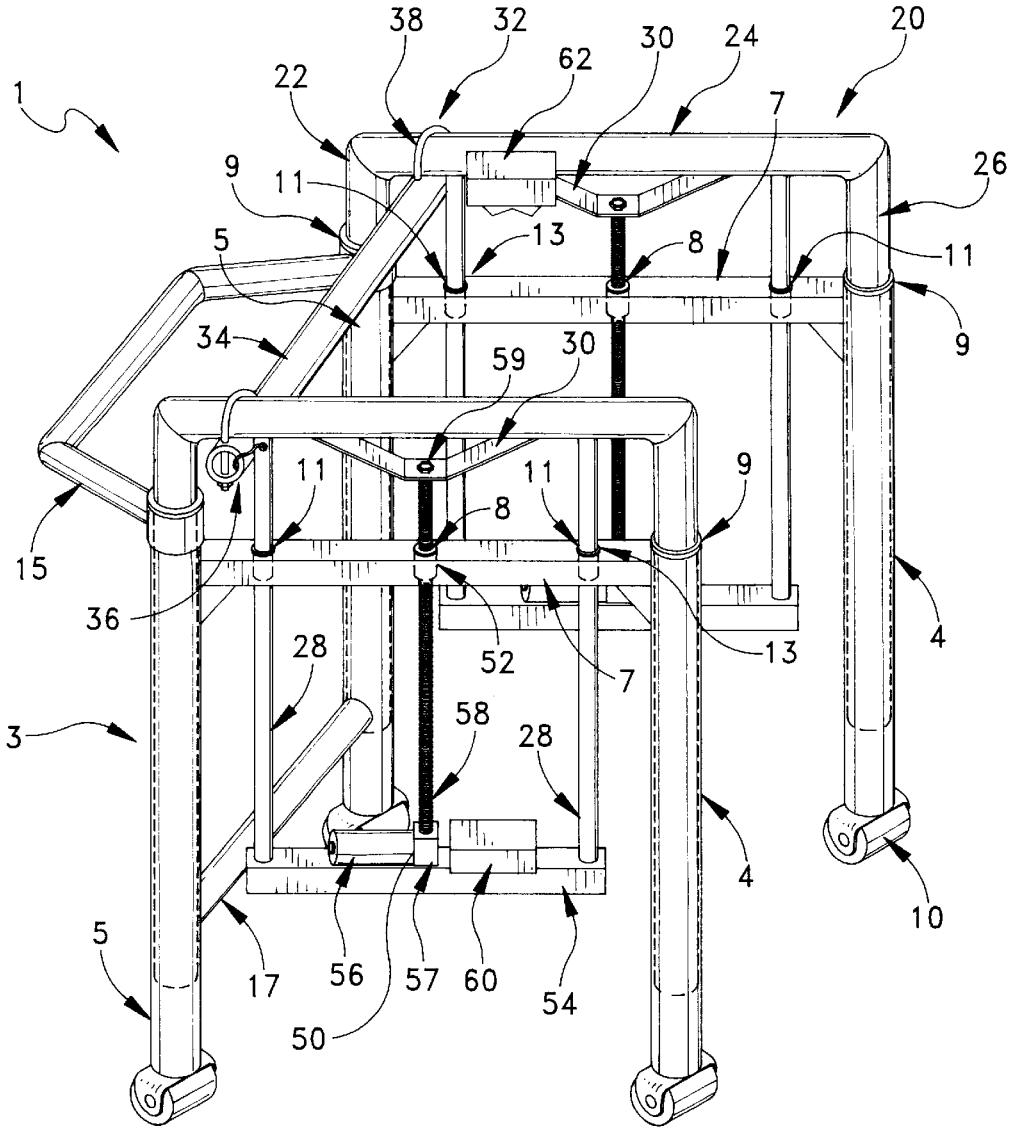
FIG. 1 is a side view of my personal lifting device, with the elevating handles in the retracted position.
Figure 2:
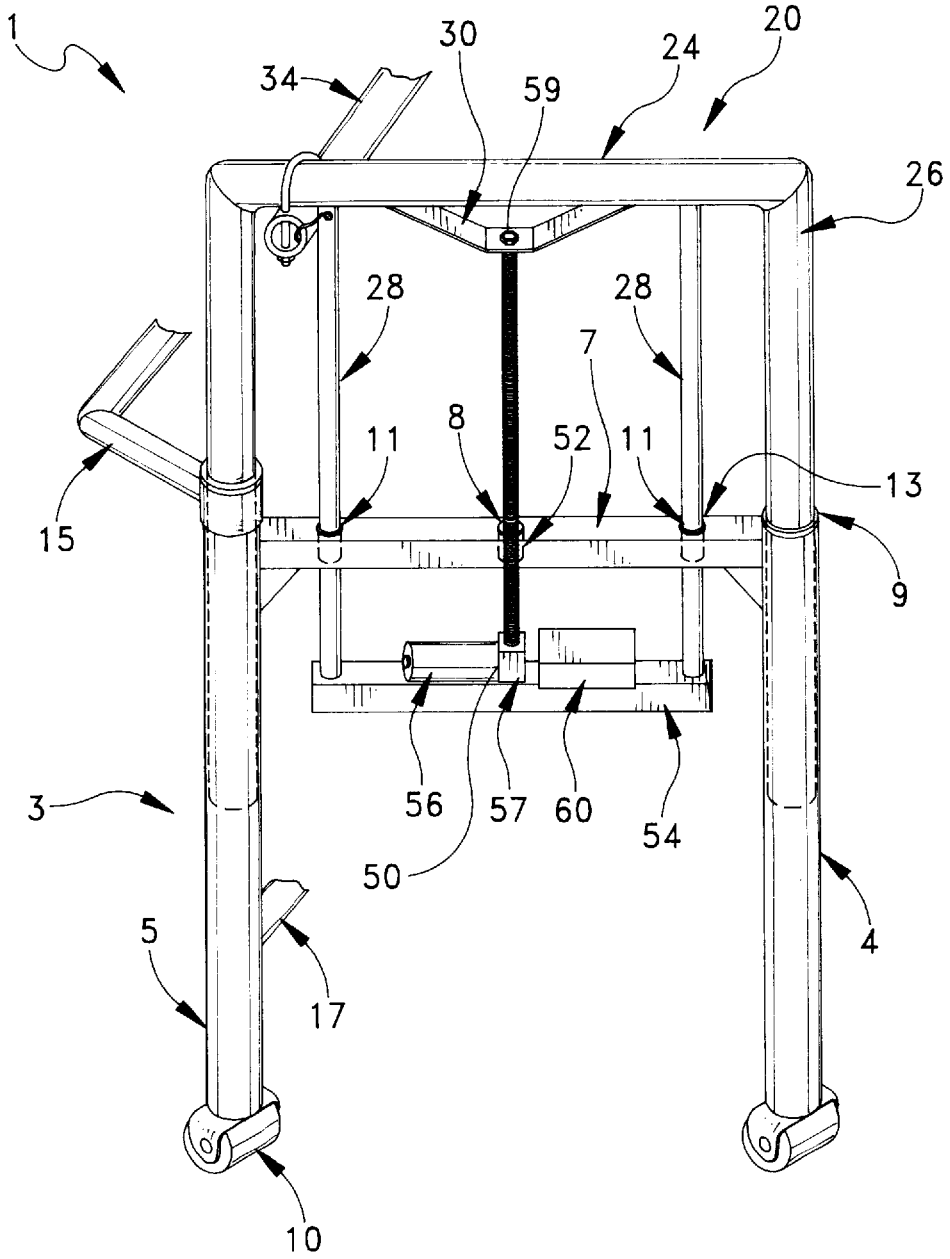
FIG. 2 is a partial view of the elevating handles in the extended position.

FIG. 1 and 2 illustrate an embodiment of the present invention referred to by the general reference character 1. In FIG. 1 the apparatus is illustrated as it would appear when it is in a position to lift a person from a sitting position to a standing position. The lifting device includes a base support 3. The base support can be made of lightweight tubular aluminum; however, other metals and metal alloys such as titanium or stainless steel, polymers, such as PVC or polypropylene, or composite materials (carbon fiber reinforced materials) may also be used. Metal and metal alloy materials may be teflon coated or coated with a chrome finish. The base support must be flexible enough to accommodate a variety of terrain yet stable enough to support the weight of the user. Best results were obtained with ½" diameter 6061 T6 aluminum tubing with at least a 1/16" inch wall thickness.

The base support is comprised of rear legs 4 and front legs 5, both of which are hollow. Wheels 10 may be connected to each leg to allow the lifting device to roll over a surface. Bushing tube 9 resides inside the top of each leg 4 and 5 and forms a lip over the top of each leg. Bushing tube 9 is made of a material that reduces friction between sliding parts, such as teflon and the like. Ball nut support 7 connects the front and rear legs forming an inverted U shaped side and thereby also contributing to an overall U-shaped frame. Ball nut support 7 has center hole 8, and actuator guide holes 11 on each side spaced apart from the center hole in the ball nut support. The holes 8 and 11 extend from the bottom surface to the top surface of the ball nut support. Ball nut support 7 can be fabricated from the same material as the base support; it is not necessary that it be hollow however, it must be strong enough to withstand the forces exerted upon it when the device raises the user. Ball nut 52 is fixed and restrained within the center hole 8. Guide bushings 13 reside in the actuator guide holes 11. The device assumes a substantially U shape, with user receptive front and spaced apart rear when the two front legs of two base supports are maintained in a spaced apart relationship by means of the front braces 15 and 17, which are themselves spaced apart and parallel to each other.

Hand rail 20, which is sidably mounted in the top of base support 3, is comprised of top rail 24, connected at one end to front rail 22, and rear rail 26, which together form another inverted U shape. Front and rear rails are also tubular stock, but of slightly smaller external diameter than the internal diameter of the bushing tubes 9. Descending from the underside of top rail 24 are two spaced apart parallel actuator support rods 28. When the hand rail is mounted on the base support, the actuator support rods 28 pass through the guide bushings 13 on the ball nut support. The hand rail and actuator support rods may also be fashioned from tubular stock to provide a guide means for the wiring that operates the device. Centered on the underside of top rail 24 is a ball screw support 30.

Elevation of the hand rail is accomplished by means of a linear actuator mechanism 50 mounted between the actuator support 54 and the underside of top rail 24. Linear actuator mechanism 50 is comprised of a gear motor 56, which drives gear reducer 57, which rotates one end of ball screw 58 through ball nut 52 which is fixedly mounted within ball nut support 7. The other end of ball screw 58 is attached to ball screw support 30 at bearing 59. Actuator support 54 is connected at each end to actuator support rods 28. Activation of gear motor 56 is accomplished by means of a power supply 60, such as a battery, and is controlled by two position rocker-type switch 62 located on hand rail 20, which allows for the lifting device to either extend from a retracted position or retract from an extended position. Additionally, the ball screw support, actuator support rods, and actuator support supply attachments points for safety shielding.

For operation, the lifting device 1 is placed with hand rails in the retracted position in front of a seated user. The user leans forward and rests his arms or hands, depending upon hand strength, on the hand rail 20. By depressing rocker switch 62, power supply 60 provides power to gear motors 56 which turn gear reducers 57 and rotate ball screws 58. Since the ball nuts are fixed, the balls screws travel their length as they rotate through the ball nuts 52, thus lifting the hand rails and the user. To be lowered from a standing position, the user rests his arms or hands on the extended hand rails and depresses the rocker switch appropriately.

A feature of the invention is that the device be easily transportable. To meet this aim, lightweight materials are used in the manufacture. For example, when 6061 T6 aluminum tubing is used, the entire device weighs approximately 11 lbs. Furthermore, the lifting device can fold for storage or transport. Front rail 22 is both sidably mounted within front leg 5, and can also be rotated within the front leg. Latch mechanism 32 permits the hand rails 20 to be securely fixed in essentially parallel spaced apart relation for use. Latch mechanism 32 consists of support tube 34 connected at each end to hinge and pin mechanism 36. Mechanism 36 can be connected to hand rail 20 at either front rail 22 or top rail 24. Support tube 34 maintains the device in a rigid U shape during use. Removal of pin 38 allows disengagement of the support tube from the hinge mechanism, allowing front rails 22 to rotate within front legs 5 and thereby folding the device for transport or storage.

Elevation of the hand rails can be accomplished by means other than mechanical power. For example, controlled release of compressed gas or hydraulic piston type arrangements can be incorporated into the general design. The hand rails can be padded for user comfort. Additionally, for a user who has fallen to the floor and needs assistance returning to a sitting or standing position, a removable knee board or strong webbing material can be fitted across the user receptive rear, resting on the actuator supports. The user can rest either arms or knees on the knee board and activate the power switch to return him to a desired position without the assistance of another person. A second power switch can be mounted low on the device, to the actuator rod for example, that will recess the hand rails when they are in an elevated position and facilitate the use of the device with knee board adaptation. Each leg can be further adapted to accept adjustable height tubes to position the lifting device at a comfortable level for users of different heights. The front legs can also be fitted with wheels, while the rear legs are fitted with rubber stoppers to provide a sure grip to the supporting surface during operation.

Figure 3:
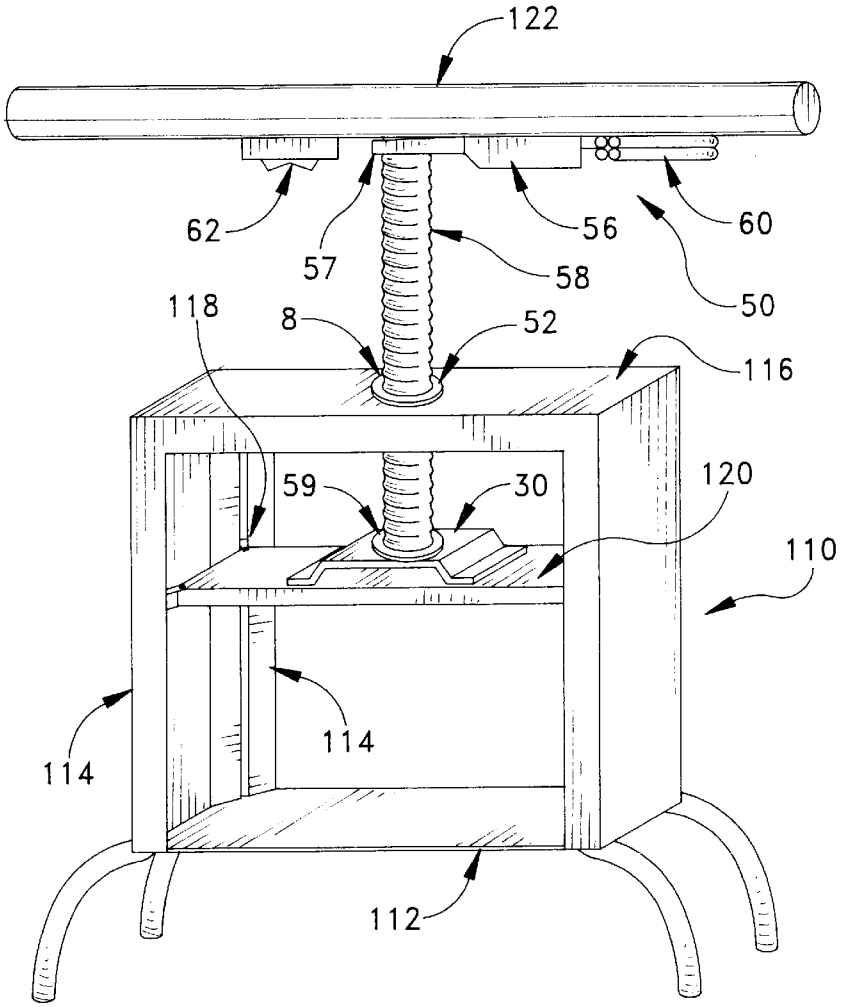
FIG. 3 and FIG. 3A illustrates an alternate configuration for my personal lifting device.
Figure 3A:
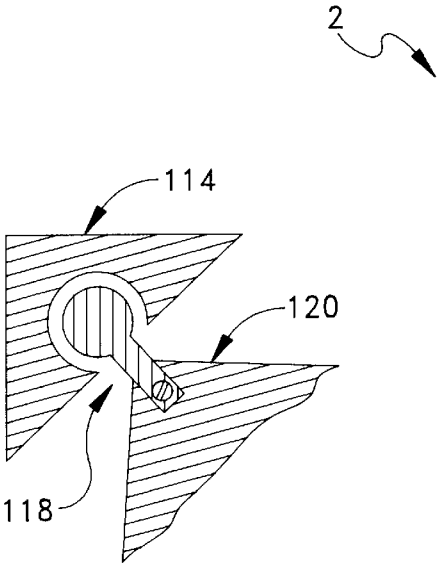

The lifting device can assume the shape shown in FIG. 3 and represented by the reference numeral 2. In this configuration, the base support 110 consists of a four legged base 112, and four longitudinally slotted frame supports 114 of substantially equivalent height arising from the base held in spaced apart parallel relation by the ball nut support 116. The ball nut support is essentially rectangular with an open center channel 8 receptive for fixedly mounting the ball nut 52. A moving platform 120 is located beneath the ball nut support 116 and is adapted to be guided in the longitudinally slotted channels of frame support 114 by the four channel guides 118 located at the corners of the moving platform. A hand rail 122 is centrally mounted on a linear actuator mechanism 50. As in the reference 1 lifting device, elevation of the hand rail is accomplished by means of the linear actuator mechanism 50. Linear actuator mechanism 50 is comprised of a gear motor 56, which drives gear reducer 57 to rotate ball screw 58 through fixed ball nut 52. Ball screw

58 is ultimately attached to ball screw support 30 at flange 59 in the moving platform. The gear motor, rocker switch 62, and power supply are located on the underneath side of the hand rail. Since the ball nut is fixed in position in the ball nut support, the rotating ball screw travels its length through the stationary ball nut and thereby raises or lowers the handle and the moving platform; the moving platform is restricted to axial motion by travel of the channel guides within the longitudinal slotted channels. At full extension the top of the moving platform is nearly in contact with the bottom of the ball nut support; at full retraction, the bottom of the moving platform nearly touches the top of the base. Adjustments within this travel distance are possible. This configuration has the advantage of being smaller than the device shown in FIG. 1 and can be used in a bed or automobile. Again, it can be fabricated from the same materials as the FIG. 1 device, and modified to accept other power sources, stoppered legs or wheels. Again the handle can be padded, appropriate safety shields applied.

I claim:

1. A lightweight, easily transportable lifting device for assisting a person to rise from a seated position which comprises:

(i) a substantially U shaped base support adapted to be disposed upon a supporting surface, having a user receptive front and a spaced apart rear, said base support further comprising:

(a) a pair of hollow front legs secured in spaced apart relation by at least one front brace;

(b) a pair of hollow rear legs; and (c) a pair of spaced apart horizontal supports each support having a plurality of evenly spaced vertically oriented apertures, each horizontal support mounted between one front and one rear leg;

(ii) a pair of spaced apart substantially inverted U shaped handrails, each of said handrails further comprising:

(a) a front rail, (b) a rear rail, and (c) a top rail connected between the front rail and rear rail to form the inverted U shape, each of said front rails and said rear rails fabricated with an outside cross sectional diameter smaller than the inside cross sectional diameter of each of the front and rear legs permitting the hand rail to be slidably mounted within said front and rear legs;

(iii) an actuator support suspended below each horizontal support, maintained at fixed distance below the top rail by a plurality of support rods;

(iv) elevation control means connected between the handrail and actuator support and capable of providing linear motion to the hand rail between a first extended position and a second retracted position relative to the base support; and (v) a motor means connected to the elevation control means providing controlled operation thereof.

2. The lifting device of claim 1 wherein the motor means comprises a motor, a power supply, and an electric switch interconnected between the motor and the power supply for controlling the motor.

3. The lifting device of claim 2 wherein the motor means is selected from the group consisting of hydraulic, electric, mechanical, and compressed gas.

4. The lifting device of claim 3 wherein the elevation control means comprises:

(i) a gear reducer driven by the motor means and capable of providing rotational motion;

(ii) a ball nut fixedly mounted within one of the horizontal support apertures;

(iii) a ball screw rotated though the ball nut by the gear reducer and secured between the hand rail and the actuator support.

5. The lifting device of claim 4 wherein each motor means provides substantially synchronous controlled operation to the handrail.

6. The lifting device of claim 5 wherein the base is further adapted for rolling movement over the supporting surface.

7. The lifting device of claim of claim 4 wherein the frame is fabricated from the group consisting of metal, metal alloys, machinable polymers, titanium, and composite materials.

8. The lifting device of claim 7 wherein the metal is aluminum.

* * * * *